US012704351B1

(12) United States Patent
Porat

(10) Patent No.: US 12,704,351 B1
(45) Date of Patent: Aug. 11, 2026

(54) CLOSABLE PISTOL STABILIZER ASSEMBLY

(71) Applicant: RT Recover Innovations Ltd., Tel Aviv (IL)

(72) Inventor: Tamir Porat, Tel Aviv (IL)

(73) Assignee: RT Recover Innovations Ltd., Tel Aviv (IL)

( * ) Notice: Subject to any disclaimer, the term of this patent is extended or adjusted under 35 U.S.C. 154(b) by 0 days.

(21) Appl. No.: 19/232,892

(22) Filed: Jun. 10, 2025

(51) Int. Cl.
*F41C 23/12* (2006.01)
*F41C 23/04* (2006.01)

(52) U.S. Cl.
CPC ..... *F41C 23/12* (2013.01); *F41C 23/04* (2013.01)

(58) Field of Classification Search
CPC ..... F41C 23/12; F41C 23/04
USPC ..... 42/72
See application file for complete search history.

(56) References Cited

U.S. PATENT DOCUMENTS 3,267,600 A * 8/1966 Ryan ..... F41C 3/08 42/1.09
4,625,621 A * 12/1986 Warin ..... F41C 9/02 89/196
8,006,425 B2 * 8/2011 Burt ..... F41A 11/04 42/73
10,627,189 B2 * 4/2020 Faifer ..... F41C 33/001
11,408,709 B2 * 8/2022 DeSantis ..... F41C 33/0209
2009/0277066 A1 * 11/2009 Burt ..... F41A 3/66 89/1.4
2019/0195595 A1 * 6/2019 Kielsmeier ..... F41A 11/04
2019/0226797 A1 * 7/2019 Faifer ..... F41C 33/001
2020/0088493 A1 * 3/2020 Kielsmeier ..... F41A 11/04
2020/0200505 A1 * 6/2020 Brown, Jr. ..... F41C 27/00
2020/0326151 A1 * 10/2020 Griffith ..... F24F 13/10
2021/0102777 A1 * 4/2021 Kielsmeier ..... F41A 11/04
2021/0254927 A1 * 8/2021 Freeman ..... F41A 35/06
2025/0305783 A1 * 10/2025 Porat ..... F41A 11/02
2025/0305794 A1 * 10/2025 Porat ..... F41C 23/12

* cited by examiner

*Primary Examiner* — Samir Abdosh
(74) *Attorney, Agent, or Firm* — Heidi Brun Associates Ltd.; Heidi M. Brun

(57) ABSTRACT

A pistol stabilizer assembly includes a chassis that has a pistol mounting portion configured to securely support a pistol therein, and a buttstock movingly coupled to the chassis. In a closed orientation, the buttstock is moved relative to the chassis to couple with the pistol mounting portion, and if a pistol is mounted in the pistol mounting portion, to conceal the pistol. In an extended orientation, the buttstock is moved relative to the chassis away from the pistol mounting portion to expose operating portions of the pistol.

9 Claims, 5 Drawing Sheets

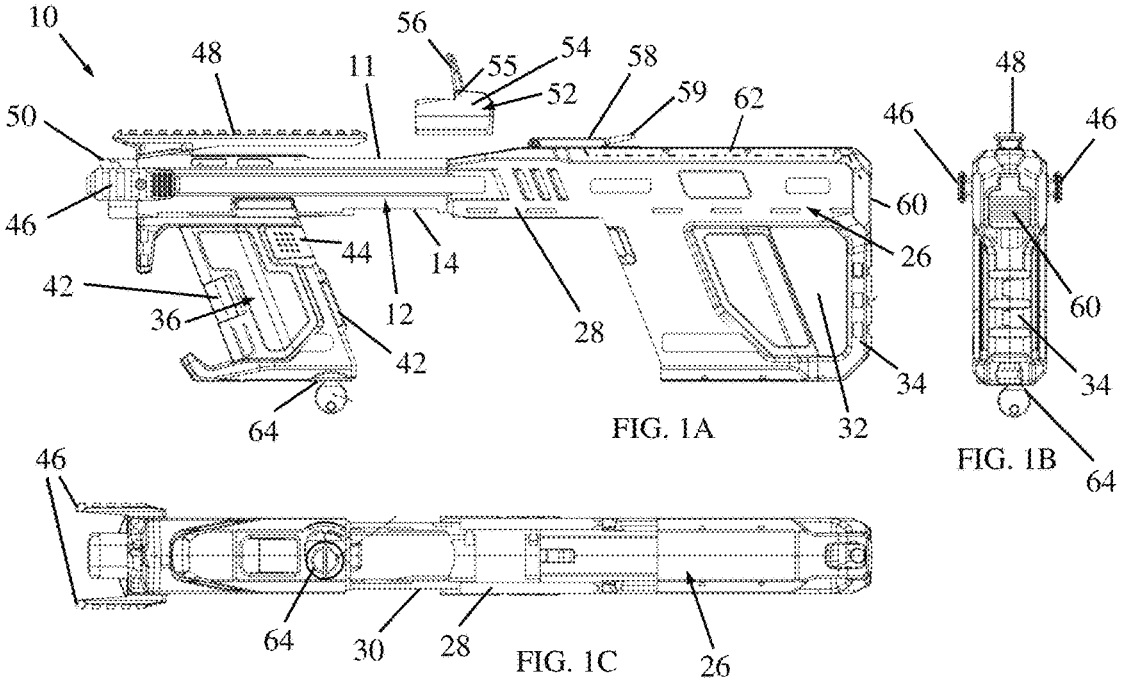
FIG. 1A
FIG. 1B
FIG. 1C
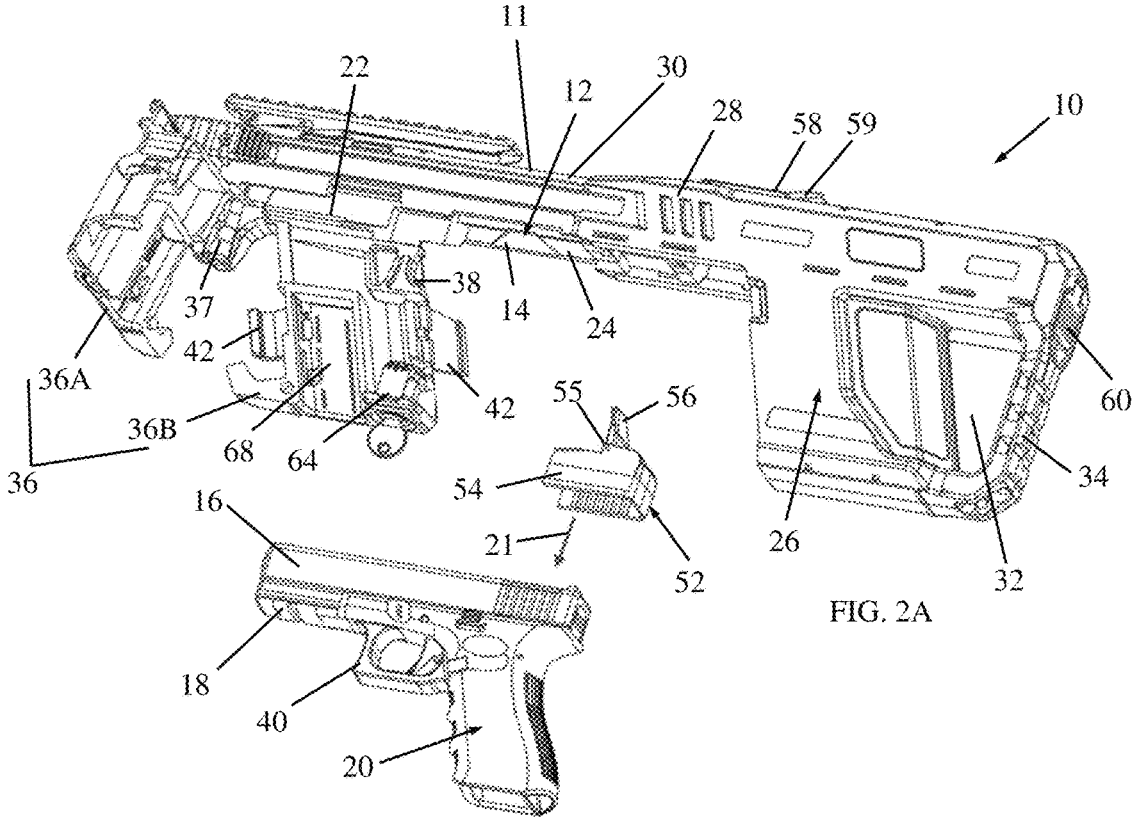
FIG. 2A

CLOSABLE PISTOL STABILIZER ASSEMBLY

FIELD OF THE INVENTION

The present invention relates to pistol stabilizers in general, and in particular to a pistol stabilizer that serves as a closable or lockable case for the pistol.

BACKGROUND OF THE INVENTION

Handguns normally are held in one hand while they are being aimed and fired, and that hand may be steadied by the other hand of the shooter or a two-handed grip A number of devices, such as pistol stabilizers or pistol braces, are designed to attach to a handgun to aid a user in holding or stabilizing the handgun. (The terms pistol and handgun are used interchangeably throughout.)

SUMMARY

The present invention seeks to provide a pistol stabilizer that serves as a closable or lockable case for the pistol, as is explained below. When the closable pistol stabilizer assembly of the invention is closed, it provides a compact storage case for the pistol. Unlike the prior art, there is no need to remove the pistol from the pistol stabilizer in order to safely store the pistol. In addition, the closable pistol stabilizer assembly may be provided with a lock so that the pistol is safely locked in the case and available only to an authorized user with an authorized key. The pistol stabilizer assembly is easily opened to an extended orientation for shooting with the pistol installed in the assembly.

There is thus provided in accordance with a non-limiting embodiment of the invention a pistol stabilizer assembly including a chassis that has a pistol mounting portion configured to securely support a pistol therein, and a buttstock movingly coupled to the chassis, wherein in a closed orientation, the buttstock is moved relative to the chassis to couple with the pistol mounting portion, and if a pistol is mounted in the pistol mounting portion, to conceal the pistol, and wherein in an extended orientation, the buttstock is moved relative to the chassis away from the pistol mounting portion to expose operating portions of the pistol.

In accordance with a non-limiting embodiment of the invention, the pistol stabilizer assembly further includes a lock configured to lock the buttstock to the pistol mounting portion in the closed orientation.

In accordance with a non-limiting embodiment of the invention, the pistol stabilizer assembly further includes a latch for maintaining the assembly in the closed orientation and a latch release button coupled to the latch for releasing the closed position so the assembly can be moved to the extended orientation.

In accordance with a non-limiting embodiment of the invention, the pistol mounting portion includes an elongate channel into which a slide and a portion of a receiver of the pistol are mountable, a forward support and a rear support for respectively supporting a front portion of the receiver and a rear portion of the receiver, and a front grip that includes a trigger guard support for supporting a trigger guard of the pistol.

In accordance with a non-limiting embodiment of the invention, the front grip includes a first front grip half hinged to the chassis and a second front grip half, and the first front grip half and the second front grip half are securable together by one or more clasps.

In accordance with a non-limiting embodiment of the invention, the buttstock includes a forward nose portion that slides along the chassis.

In accordance with a non-limiting embodiment of the invention, the buttstock includes a rear window to form a carrying handle.

In accordance with a non-limiting embodiment of the invention, the front grip includes a thumb rest.

In accordance with a non-limiting embodiment of the invention, the chassis includes one or more weapon accessories rails.

In accordance with a non-limiting embodiment of the invention, the pistol stabilizer assembly further includes a charging handle accessory for attachment to the pistol.

BRIEF DESCRIPTION OF DRAWINGS

The present invention will be understood and appreciated more fully from the following detailed description, taken in conjunction with the drawings in which:

FIGS. 1A, 1B and 1C are simplified side-view, rear-view and bottom-view illustrations, respectively, of a closable pistol stabilizer assembly, in accordance with a non-limiting embodiment of the present invention.

FIGS. 2A, 2B, 2C, 2D, and 2E are perspective illustrations of steps in mounting a pistol in the closable pistol stabilizer assembly, wherein in FIG. 2A a charging handle attachment is about to be placed on the pistol, in FIG. 2B the charging handle attachment has been placed on the pistol, in FIG. 2C the pistol has been mounted in the closable pistol stabilizer assembly, in FIG. 2D the closable pistol stabilizer assembly has been moved from a fully extended position to a partially extended position, and in FIG. 2E the closable pistol stabilizer assembly has been closed and locked.

(FIG. 4A shows a spare magazine inserted in a spare magazine well of a forward grip of the closable pistol stabilizer assembly).

DETAILED DESCRIPTION

Reference is now made to FIGS. 1A, 1B and 1C, which illustrate a closable pistol stabilizer assembly 10, in accordance with a non-limiting embodiment of the present invention. The assembly 10 may be structured and sized to accept any brand of handgun, including subcompact handguns.

Figure 2B:
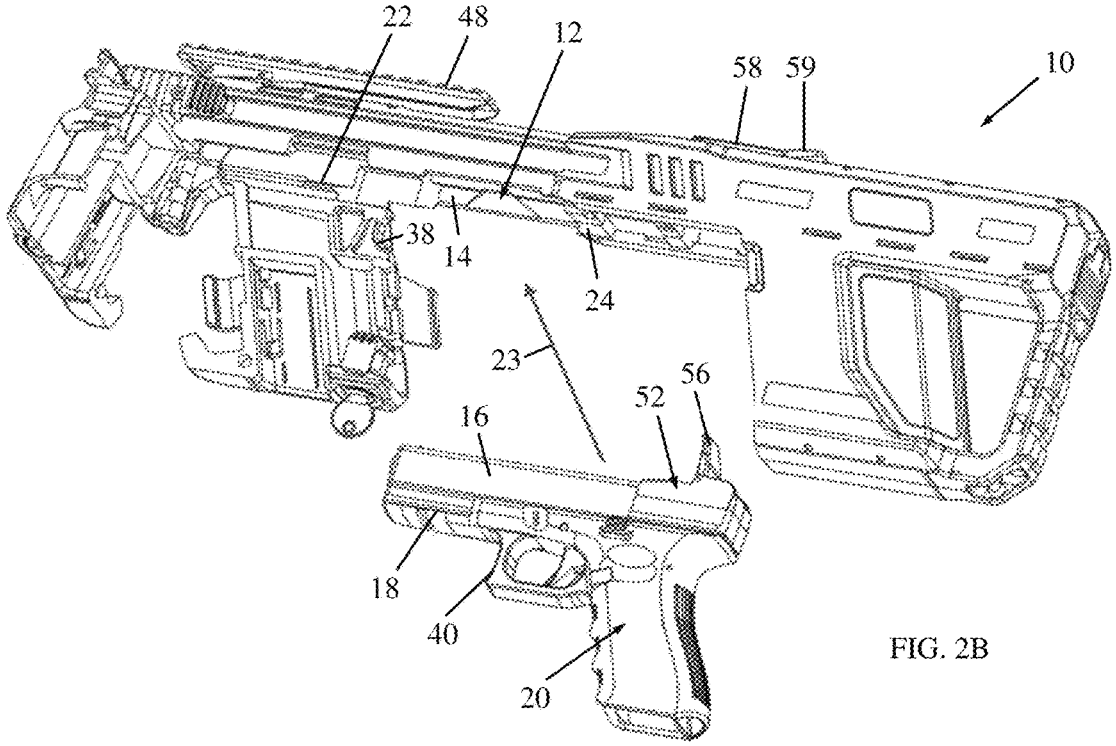
Figure 2C:
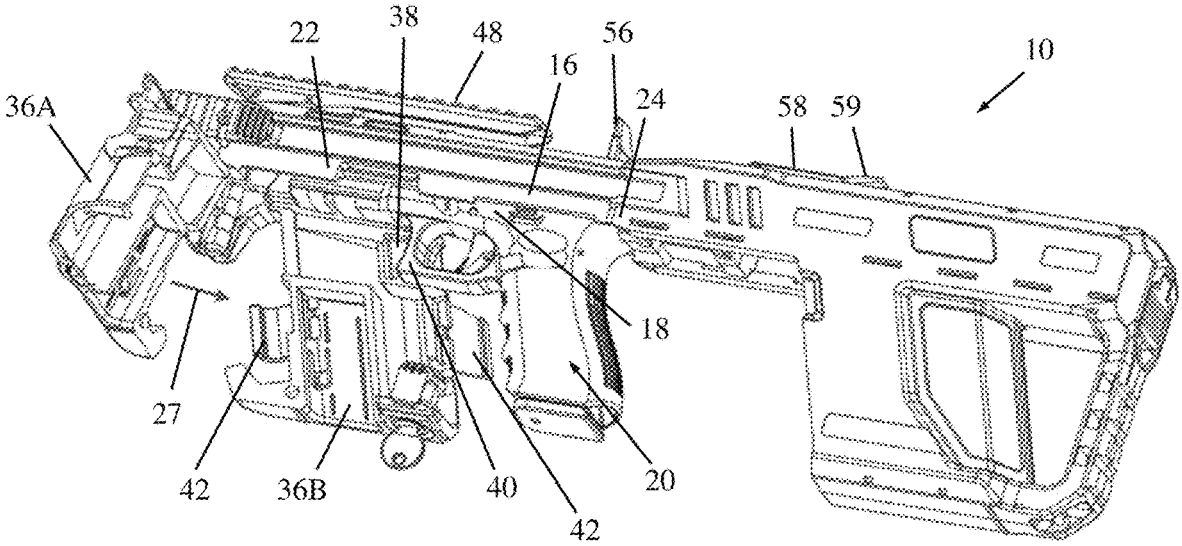

Assembly 10 may include a chassis 11 that has a pistol mounting portion 12 (shown in FIG. 1A and seen best in FIGS. 2A and 2B), which may include an elongate channel 14 into which a slide 16 and a portion of a receiver 18 of a pistol 20 may be received. The pistol mounting portion 12 may also include a forward support 22 and a rear support 24 for respectively supporting a front portion of the receiver 18 and a rear portion of the receiver 18 (such as the rear portion of the grip or the beavertail or any other suitable portion of the pistol 20), as seen in FIGS. 2A-2C. The elongate channel 14 is dimensioned such that it does not interfere with the reciprocating motion of the slide 16.

As seen in FIG. 1A, buttstock unit 26 may be movingly coupled to chassis 11 (such as, without limitation, being slidingly coupled or rotatingly coupled to the chassis). For example, in the non-limiting illustrated embodiment, buttstock unit 26 may include a forward nose portion 28 that slides along grooves 30 formed on outer surfaces of chassis 11. The buttstock unit 26 may have a rear window 32 so that the rear face 34 (FIG. 1A) serves as a carrying handle when the closable pistol stabilizer assembly 10 is closed to form a carrying case.

A front grip 36 (such as an angled front grip) may extend from a bottom portion of the chassis 11. Front grip 36 may be made of two halves: first front grip half 36A and second front grip half 36B. Front grip half 36B may be located just below forward support 22; in one embodiment, forward support 22 may be part of front grip half 36B. Front grip half 36B may include a trigger guard support 38 (FIG. 2A) for supporting a trigger guard 40 of pistol 20. The front grip half 36A may be hinged to chassis 11 by a hinge 37 (FIG. 2A). The first front grip half 36A and second front grip half 36B may be secured together by one or more clasps 42. As seen in FIG. 1A, a thumb rest 44 may be located on an outer surface of front grip 36.

Chassis 11 may include one or more side weapon accessories rails (such as Picatinny rails) 46 (FIGS. 1A-1C) and an upper weapon accessories rail (such as a Picatinny rail) 48 (FIGS. 1A-1B). The upper weapon accessories rail 48 is particularly useful for mounting thereon optical sights and the like.

Chassis 11 may include a front metal guard 50 (FIG. 1A) to protect the chassis 11.

As an option, a charging handle accessory 52 (seen in FIGS. 1A, 2A, and 2B) may be provided for attachment to the slide 16 of pistol 20. As seen in FIG. 2A, the charging handle accessory 52 may include a body 54 that fits over the slide 16 (body 54 may have internal serrations that match the external serrations of the slide). A pivoting charging lever 56 may be pivoted to body 54 at a pivot 55. The pivot allows the lever 56 to fold down in the forward direction, but the lever 56 is constrained not to pivot past the upright position shown in FIG. 2A, by abutting against a portion of body 54.

Figure 3A:
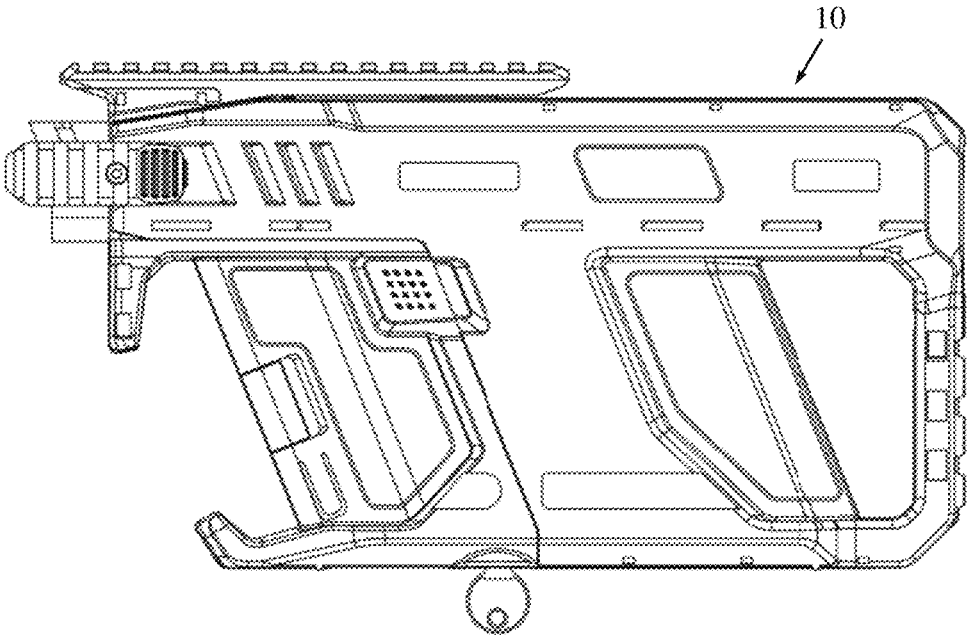
FIGS. 3A and 3B are side-view and perspective illustrations, respectively, of the closable pistol stabilizer assembly in the closed and locked orientation.
Figure 3B:
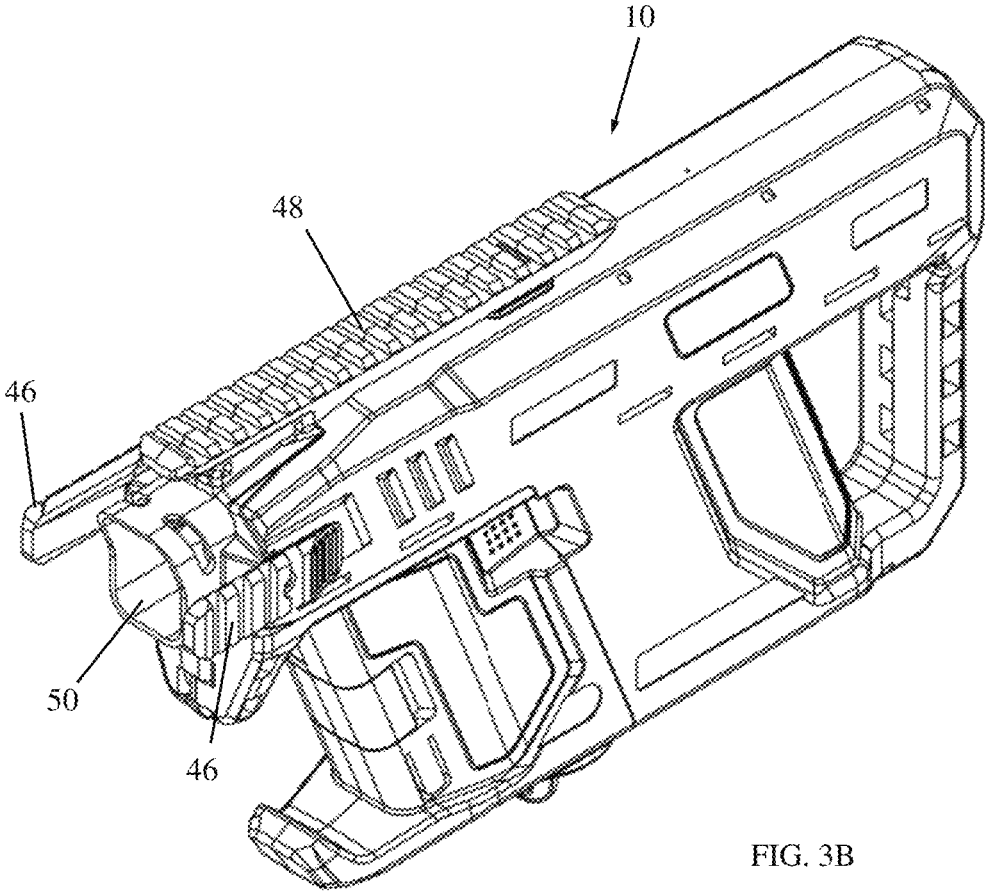
Figure 4A:
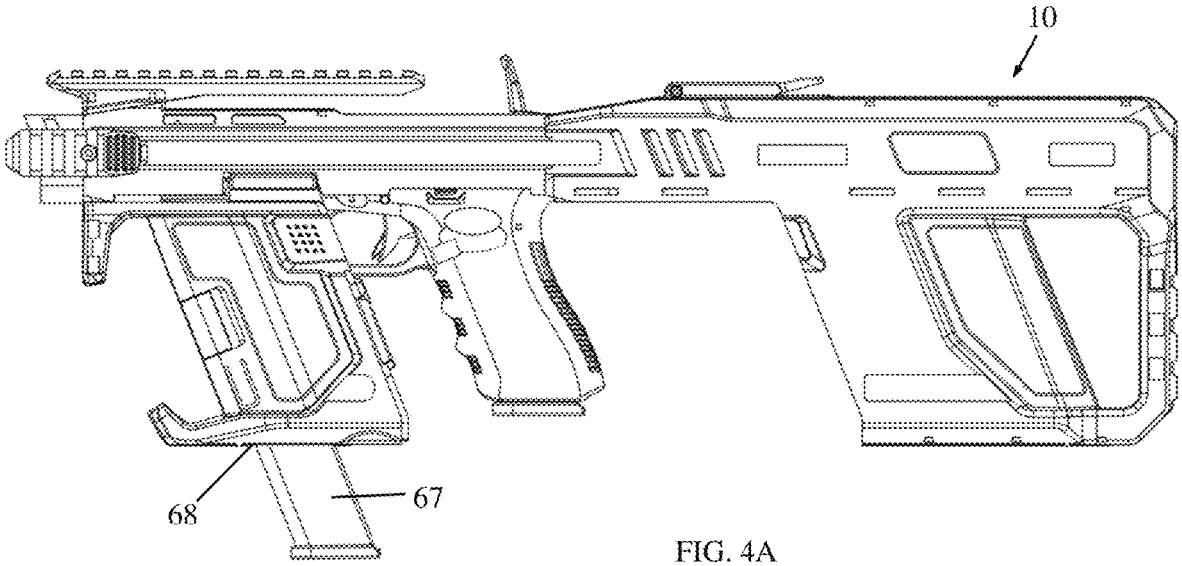
FIGS. 4A and 4B are side-view and perspective illustrations, respectively, of the closable pistol stabilizer assembly in the fully extended orientation, and ready for shooting
Figure 4B:
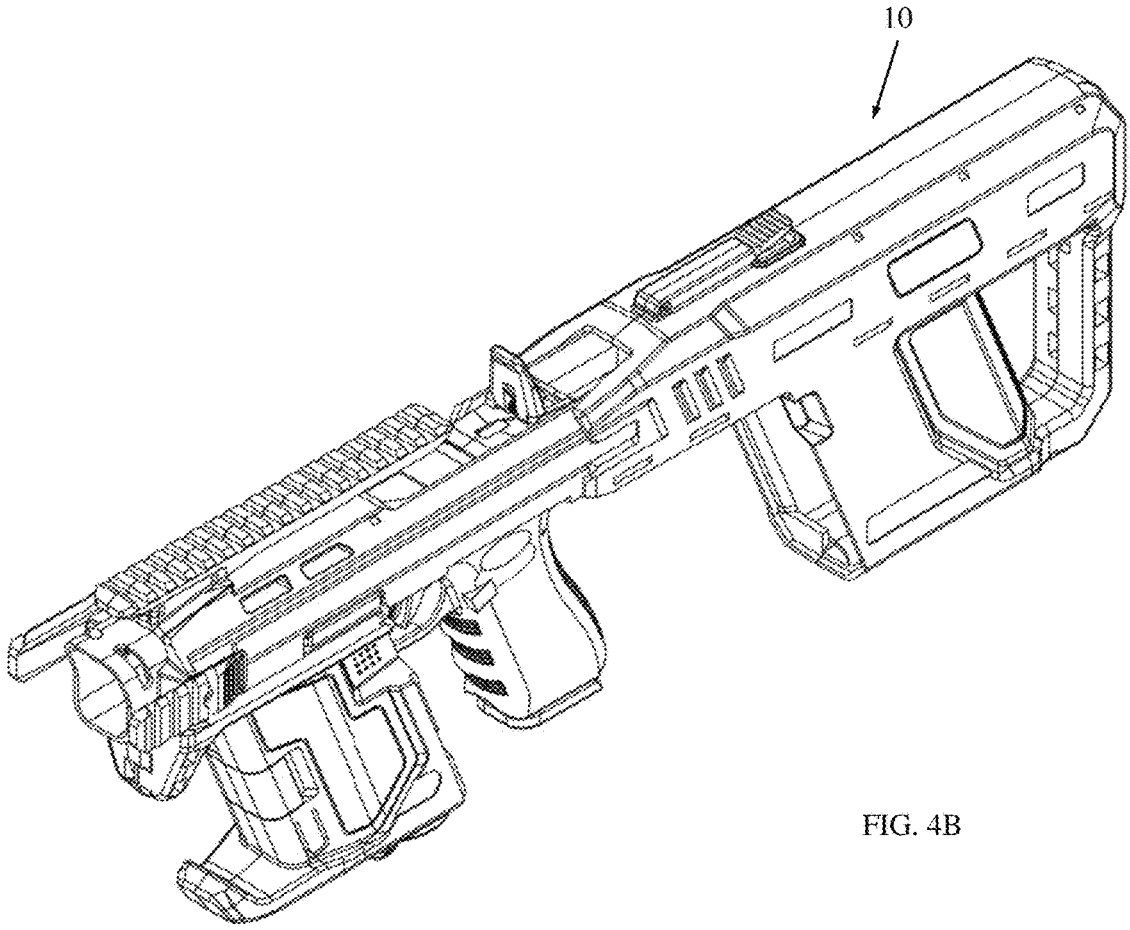

The closable pistol stabilizer assembly 10 may have provisions for maintaining the assembly in the closed orientation (of FIGS. 3A and 3B) and for releasing the closed position so the assembly 10 can be moved to the extended orientation (of FIGS. 4A and 4B). For example, in the non-limiting illustrated embodiment, a latch 58 may be mounted on the upper side of the buttstock 26. Latch 58 may include a pivoting lever 59. A latch release button 60 (which may be spring-loaded) may be mounted at the end of buttstock 26, and may be coupled by a link 62 (shown in broken lines in FIG. 1A) to latch 58 and/or pivoting lever 59. Pivoting lever 59 may be spring-loaded to be biased upwards.

It is noted that latch 58 and latch release button 60 may be mounted in other places in the assembly 10.

The closable pistol stabilizer assembly 10 may include a lock 64, such as but not limited to, a key-operated cylinder lock, an electronic lock, a fingerprint-identification lock, and others. Lock 64 may be mounted in second front grip half 36B, as seen in FIG. 2A.

Reference is now made to FIGS. 2A, 2B, 2C, 2D, and 2E, which illustrate steps in mounting pistol 20 in the closable pistol stabilizer assembly 10.

In FIG. 2A, charging handle accessory 52 is about to be placed on the pistol 20 by moving in the direction of arrow 21. The closable pistol stabilizer assembly 10 is open and ready to accept the pistol 20.

In FIG. 2B, charging handle accessory 52 has been placed on pistol 20. Pistol 20 is now ready to be mounted in closable pistol stabilizer assembly 10 in the direction of arrow 23.

In FIG. 2C, pistol 20 has been mounted in the closable pistol stabilizer assembly 10. The trigger guard 40 is supported by trigger guard support 38, forward support 22 supports the front portion of the receiver 18 and rear support 24 supports the rear portion of the receiver 18. The front grip half 36A is about to be pivoted about hinge 37 in the direction of arrow 27 and be securely closed by clasps 42 to second front grip half 36B, so that the pistol 20 is securely held between first front grip half 36A and second front grip half 36B.

Figure 2D:
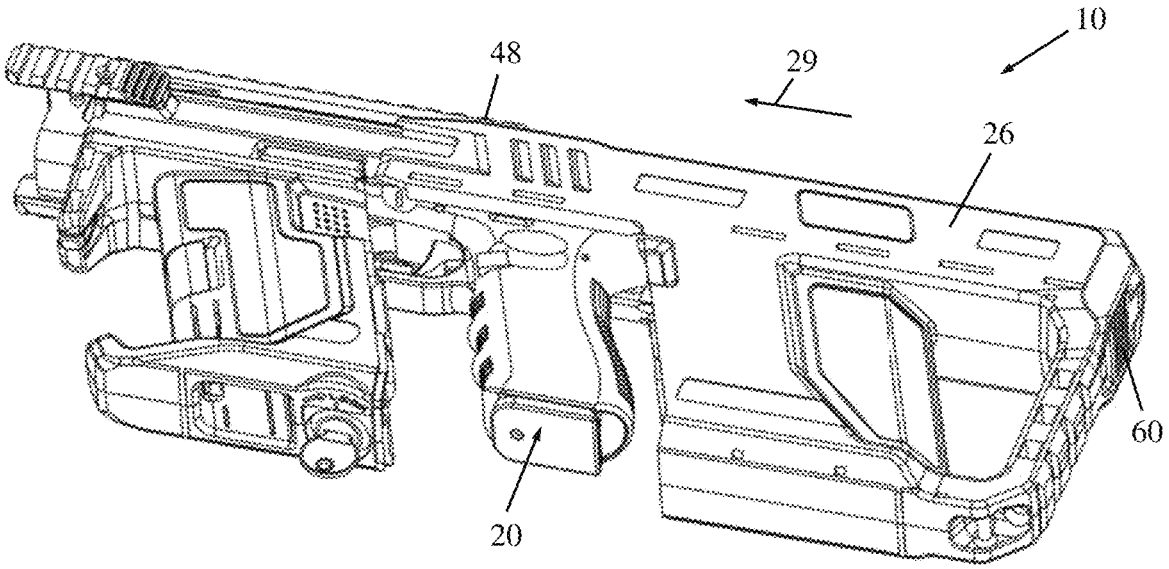

In FIG. 2D, the closable pistol stabilizer assembly 10 has been moved from a fully extended position to a partially extended position by sliding buttstock 26 forward in the direction of arrow 29. As buttstock 26 is moved forward, it first abuts against lever 56 if the charging handle accessory (shown in FIG. 2C) and causes lever 56 to fold down in the forward direction, so that lever 56 will slide under the weapon accessories rail 48 upon continuing to move buttstock 26 forward. After the lever 56 has been folded down, continued movement of buttstock 26 forward brings latch 58 and pivoting lever 59 (shown in FIG. 2C) under the weapon accessories rail 48, so that pivoting lever 59 securely catches on to an underside of weapon accessories rail 48. When it is desired to move the assembly to the extended orientation, the latch release button 60 may be pressed, which pivots pivoting lever 59 downward to release pivoting lever 59 from the weapon accessories rail 48 so that the buttstock 26 can be moved rearward to the extended orientation.

Figure 2E:
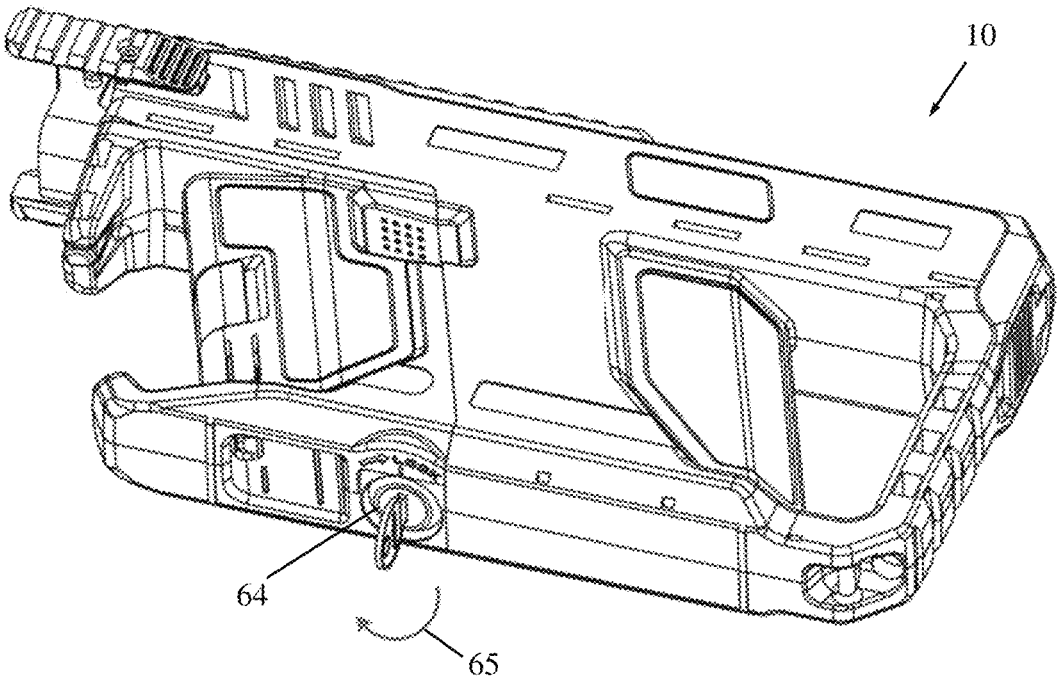

In FIG. 2E, the closable pistol stabilizer assembly 10 has been closed and locked by locking lock 64, such as by turning the key of the key-operated cylinder lock in the direction of arrow 65.

FIGS. 3A and 3B illustrate the closable pistol stabilizer assembly 10 in the closed and locked orientation. The pistol is completely concealed inside the assembly.

FIGS. 4A and 4B illustrate the closable pistol stabilizer assembly 10 in the fully extended orientation, and ready for shooting. The operating portions (such as the trigger, safety and firing selector) of the pistol are exposed for use by the shooter. FIG. 4A shows a spare magazine 67 inserted in a spare magazine well 68 (also seen in FIG. 2A) of the forward grip of the closable pistol stabilizer assembly 10.

Optionally, the closable pistol stabilizer assembly 10 may include a light (such as being mounted in front metal guard 50 and powered by a battery) so that the assembly may serve as a flashlight.

The invention claimed is:

1. A pistol stabilizer assembly comprising:

a chassis that has a pistol mounting portion configured to securely support a pistol therein; and a buttstock comprising a forward nose portion that slides along said chassis, wherein in a closed orientation, said buttstock is moved relative to said chassis to couple with said pistol mounting portion, and if a pistol is mounted in said pistol mounting portion, to conceal the pistol, and wherein in an extended orientation, said buttstock is moved relative to said chassis away from said pistol mounting portion to expose operating portions of the pistol.

2. The pistol stabilizer assembly according to claim 1, further comprising a lock configured to lock said buttstock to said pistol mounting portion in the closed orientation.

3. The pistol stabilizer assembly according to claim 1, further comprising a latch for maintaining the assembly in the closed orientation and a latch release button coupled to said latch for releasing the closed position so the assembly can be moved to the extended orientation.

4. The pistol stabilizer assembly according to claim 1, wherein said pistol mounting portion comprises an elongate channel into which a slide and a portion of a receiver of the pistol are mountable, a forward support and a rear support for respectively supporting a front portion of the receiver and a rear portion of the receiver, and a front grip that comprises a trigger guard support for supporting a trigger guard of the pistol.

5. The pistol stabilizer assembly according to claim 4, wherein said front grip comprises a first front grip half hinged to said chassis and a second front grip half, and said first front grip half and said second front grip half are securable together by one or more clasps.

6. The pistol stabilizer assembly according to claim 1, wherein said buttstock comprises a rear window to form a carrying handle.

7. The pistol stabilizer assembly according to claim 4, wherein said front grip comprises a thumb rest.

8. The pistol stabilizer assembly according to claim 1, wherein said chassis comprises one or more weapon accessories rails.

9. The pistol stabilizer assembly according to claim 1, further comprising a charging handle accessory for attachment to the pistol.

* * * * *